US008292691B2

(12) United States Patent
Xu et al.

(10) Patent No.: US 8,292,691 B2
(45) Date of Patent: Oct. 23, 2012

(54) USE OF PAD CONDITIONING IN TEMPERATURE CONTROLLED CMP

(75) Inventors: Kun Xu, Fremont, CA (US); Thomas H. Osterheld, Mountain View, CA (US); Jimin Zhang, San Jose, CA (US); Stephen Jew, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1059 days.

(21) Appl. No.: 12/240,615

(22) Filed: Sep. 29, 2008

(65) Prior Publication Data

US 2010/0081360 A1 Apr. 1, 2010

(51) Int. Cl.
*B24B 49/14* (2006.01)

(52) U.S. Cl. ..... 451/5; 451/7

(58) Field of Classification Search ..... 451/5, 287, 451/288, 289, 7, 53
See application file for complete search history.

(56) References Cited

U.S. PATENT DOCUMENTS

| | | | | |
|---|---|---|---|---|
| 5,749,772 | A * | 5/1998 | Shimokawa | 451/53 |
| 5,957,750 | A * | 9/1999 | Brunelli | 451/7 |
| 6,224,461 | B1 | 5/2001 | Boehm, Jr. et al. | |
| 6,402,597 | B1 * | 6/2002 | Sakurai et al. | 451/56 |
| 6,652,708 | B2 | 11/2003 | Kneer | |
| 6,726,530 | B2 | 4/2004 | Mikhaylich et al. | |
| 6,736,720 | B2 | 5/2004 | Bright et al. | |
| 6,884,162 | B2 | 4/2005 | Raverdy et al. | |
| 6,953,750 | B1 | 10/2005 | Wu et al. | |
| 6,984,162 | B2 | 1/2006 | Bright et al. | |
| 7,029,369 | B2 | 4/2006 | Mikhaylich et al. | |
| 2007/0227901 | A1 | 10/2007 | Hu et al. | |

* cited by examiner

*Primary Examiner* — Robert Rose
(74) *Attorney, Agent, or Firm* — Patterson & Sheridan, LLP

(57) ABSTRACT

A method and apparatus for temperature control for a chemical mechanical polishing process is provided. In one embodiment, the method comprises polishing the substrate with a surface of a polishing pad assembly, measuring a real-time temperature of the surface of the polishing pad assembly, determining whether the real-time temperature of the surface of the polishing pad assembly is within a predetermined processing temperature range, and contacting the surface of the polishing pad assembly with a pad conditioner to adjust the temperature of the surface of the polishing pad assembly to fall within the predetermined temperature range.

20 Claims, 6 Drawing Sheets

USE OF PAD CONDITIONING IN TEMPERATURE CONTROLLED CMP

BACKGROUND OF THE INVENTION

1. Field of the Invention

Embodiments described herein relate to removing material from a substrate. More particularly, the embodiments described herein relate to temperature control for a chemical mechanical polishing process.

2. Description of the Related Art

Sub-quarter micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

Multilevel interconnects are formed using sequential material deposition and material removal techniques on a substrate surface to form features therein. As layers of materials are sequentially deposited and removed, the uppermost surface of the substrate may become non-planar across its surface and require planarization prior to further processing. Planarization or "polishing" is a process in which material is removed from the surface of the substrate to form a generally even, planar surface. Planarization is useful in removing excess deposited material, removing undesired surface topography, and surface defects, such as surface roughness, agglomerated materials, crystal lattice damage, scratches, and contaminated layers or materials to provide an even surface for subsequent photolithography and other semiconductor manufacturing processes.

Chemical Mechanical Planarization, or Chemical Mechanical Polishing (CMP), is a common technique used to planarize substrates. CMP utilizes a chemical composition, such as slurries or other fluid medium, for selective removal of materials from substrates. In conventional CMP techniques, a substrate carrier or polishing head is mounted on a carrier assembly and positioned in contact with a polishing pad in a CMP apparatus. The carrier assembly provides a controllable pressure to the substrate, thereby pressing the substrate against the polishing pad. The pad is moved relative to the substrate by an external driving force. The CMP apparatus affects polishing or rubbing movements between the surface of the substrate and the polishing pad while dispersing a polishing composition to affect chemical activities and/or mechanical activities and consequential removal of materials from the surface of the substrate.

One objective of CMP is to remove a predictable amount of material while achieving uniform surface topography both within each substrate and from substrate to substrate when performing a batch polishing process.

Dishing occurs when a portion of the surface of the inlaid metal of the interconnection formed in the feature definitions in the interlayer dielectric is excessively polished, resulting in one or more concave depressions, which may be referred to as concavities or recesses. Dishing is more likely to occur in wider or less dense features on a substrate surface.

Therefore, there is a need for a polishing process which accurately and reliably removes a predictable amount of material while achieving uniform surface topography with reduced dishing.

SUMMARY OF THE INVENTION

Embodiments described herein relate to removing material from a substrate. More particularly, the embodiments described herein relate to temperature control for a chemical mechanical polishing process. In one embodiment a method of processing a semiconductor substrate is provided. The method comprises polishing the substrate with a surface of a polishing pad assembly, measuring a real-time temperature of the surface of the polishing pad assembly, determining whether the real-time temperature of the surface of the polishing pad assembly is within a predetermined processing temperature range, and contacting the surface of the polishing pad assembly with a pad conditioner to adjust the temperature of the surface of the polishing pad assembly to fall within the predetermined temperature range.

In another embodiment a method of processing a semiconductor substrate is provided. The method comprises polishing the substrate with a surface of a polishing pad assembly, measuring a series of real-time temperature measurements from a plurality of regions on the surface of the polishing pad assembly, equating each real-time temperature measurement with a particular region of the plurality of regions on the surface of the polishing pad assembly, determining whether each real-time temperature measurement of the surface of the polishing pad assembly is within a predetermined processing temperature range, and contacting at least one of a plurality of regions of the surface of the polishing pad assembly with a pad conditioner to adjust the temperature of the surface of the polishing pad assembly to fall within the predetermined temperature range.

In yet another embodiment a method of processing a substrate is provided. The method comprises determining an incoming thickness profile of a conductive material across the surface of a substrate, polishing the substrate with a surface of a polishing pad assembly, developing a real-time thickness profile model of the conductive material across the surface of the substrate, developing a real-time temperature profile model of the surface of the polishing pad assembly, and contacting the surface of the polishing pad assembly with a pad conditioner to adjust the temperature of the surface of the polishing pad assembly in response to the real-time thickness profile model of the conductive material across the surface of the substrate and the temperature profile model of the surface of the polishing pad assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiment without specific recitation.

DETAILED DESCRIPTION

Embodiments described herein generally relate to removing material from a substrate. More particularly, embodiments described herein relate to polishing or planarizing a substrate by chemical mechanical polishing (CMP). The efficiency of CMP processing can depend on the temperature of both the top surface of the polishing pad and the polishing slurry used during processing. Current CMP processing is performed at a temperature resulting from exothermal reactions occurring during processing and the processing environment.

Figure 1A:
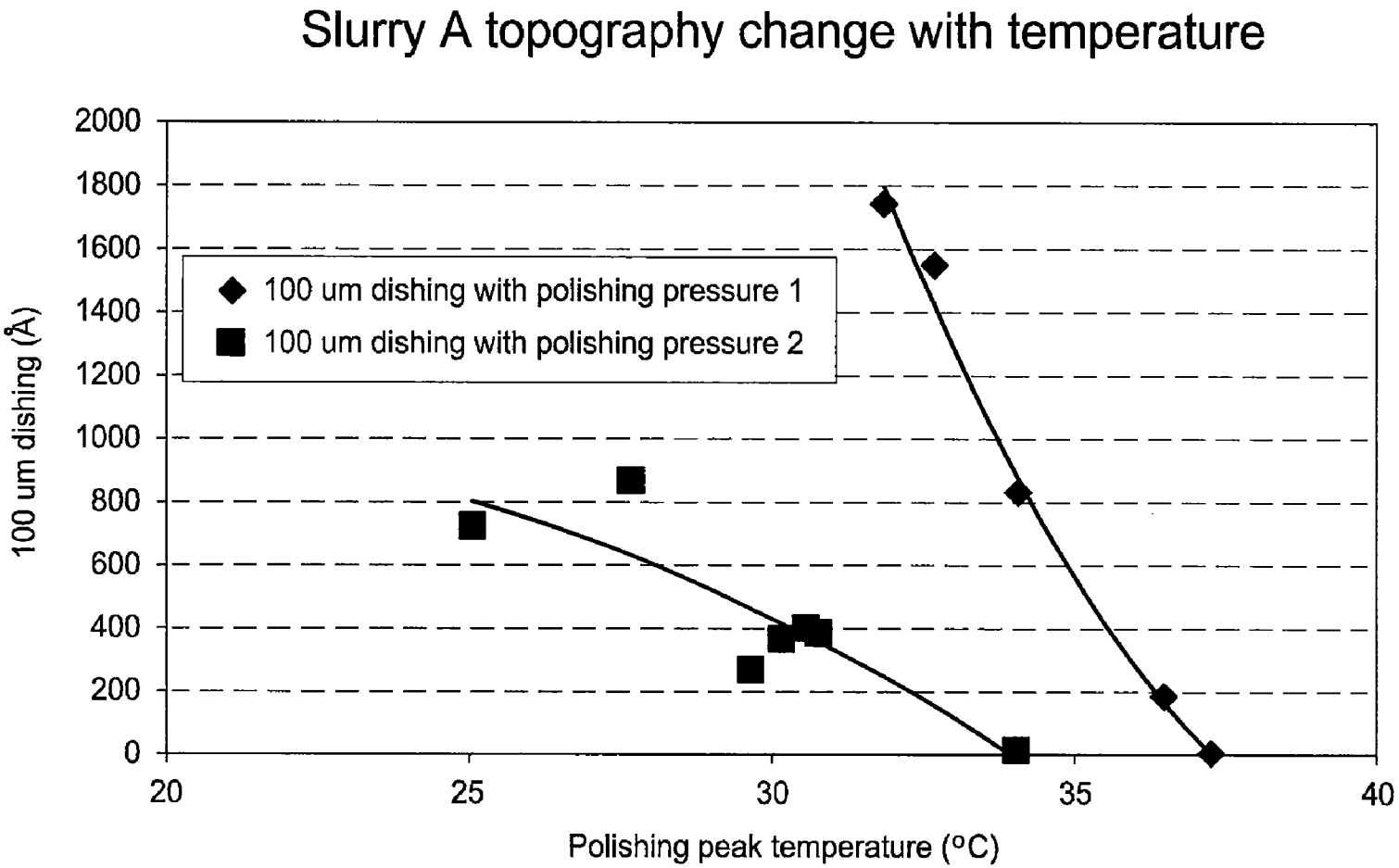
FIG. 1A is a plot showing dishing (Å) verses polishing temperature (° C.) for a chemical mechanical polishing process according to embodiments described herein.
Figure 1B:
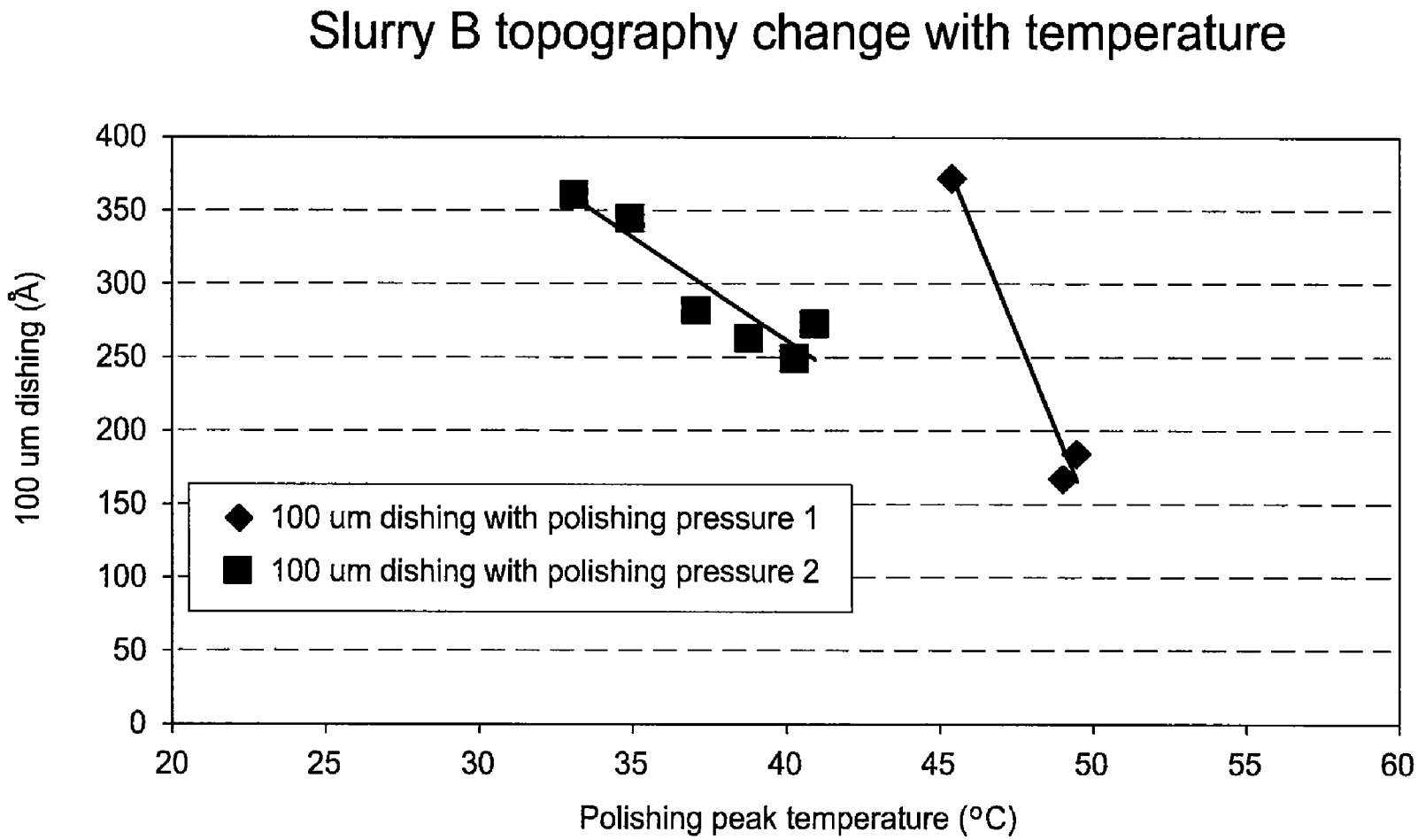
FIG. 1B is a plot showing dishing (Å) verses polishing temperature (° C.) for a chemical mechanical polishing process according to embodiments described herein.

As shown by FIGS. 1A and 1B, for certain polishing processes, such as polishing processes performed with polishing slurries, dishing decreases as the temperature of the polishing pad increases. The x-axis of FIG. 1A represents peak polishing temperature (° C.) and the y-axis represents 100 μm average ("Avg.") dishing (Å) for substrates with a copper material polished using techniques described herein. The results show that for both a low pressure and a high pressure polishing process, CMP processes performed at a higher temperature yield lower dishing. The x-axis of FIG. 1B represents peak polishing temperature (° C.) and the y-axis represents 100 μm Avg. dishing (Å) for substrates with a copper material polished using techniques described herein. The results also show that for both a low pressure and a high pressure polishing process, CMP processes performed at a higher temperature yield lower dishing. Thus, real time temperature control of CMP processes allows for better control of both polishing rate and surface topography.

One method for heating the pad applies high pressure to the retaining ring of a carrier head against the surface of a polishing pad to create high friction between the retraining ring and pad. However, this method reduces the lifespan of the retaining ring and may negatively affect the removal profile at the edge of the substrate. Another option for heating the pad uses a pad conditioning apparatus to apply high down force pressure to the surface of the polishing pad creating a similar temperature affect on the surface of the pad. The heating area may be controlled by the pad conditioner sweep profile and the temperature can be controlled by the conditioning down force. A real time temperature profile control model of the polishing pad may be developed using a feedback control model. The real time temperature profile control model may be used to control the force applied to the polishing pad by the pad conditioner, referred to as conditioning down force, at different zones of the substrate surface to achieve uniform temperature and uniform topography across the substrate.

In one embodiment, a predetermined temperature range may be selected for the polishing process. Within upper and lower limits, the system uses conditioning down force to achieve a predetermined polish temperature (based on feedback from temperature sensors) and then maintains the predetermined polishing temperature. Thus enabling more repeatable dishing and erosion performance.

While the particular apparatus in which the embodiments described herein can be practiced is not limited, it is particularly beneficial to practice the embodiments in a REFLEXION CMP system, REFLEXION LK CMP system, and a MIRRA MESA® system sold by Applied Materials, Inc., Santa Clara, Calif. Additionally, CMP systems available from other manufacturers may also benefit from embodiments described herein. Embodiments described herein may also be practiced on overhead circular track polishing systems including the overhead circular track polishing systems described in U.S. Provisional Patent Application No. 61/043,582, titled CIRCULAR TRACK POLISHING SYSTEM ARCHITECTURE and U.S. Provisional Patent Application No. 61/043,600, titled POLISHING HEAD FOR A TRACK SYSTEM both of which are hereby incorporated by reference in their entirety.

Figure 2:
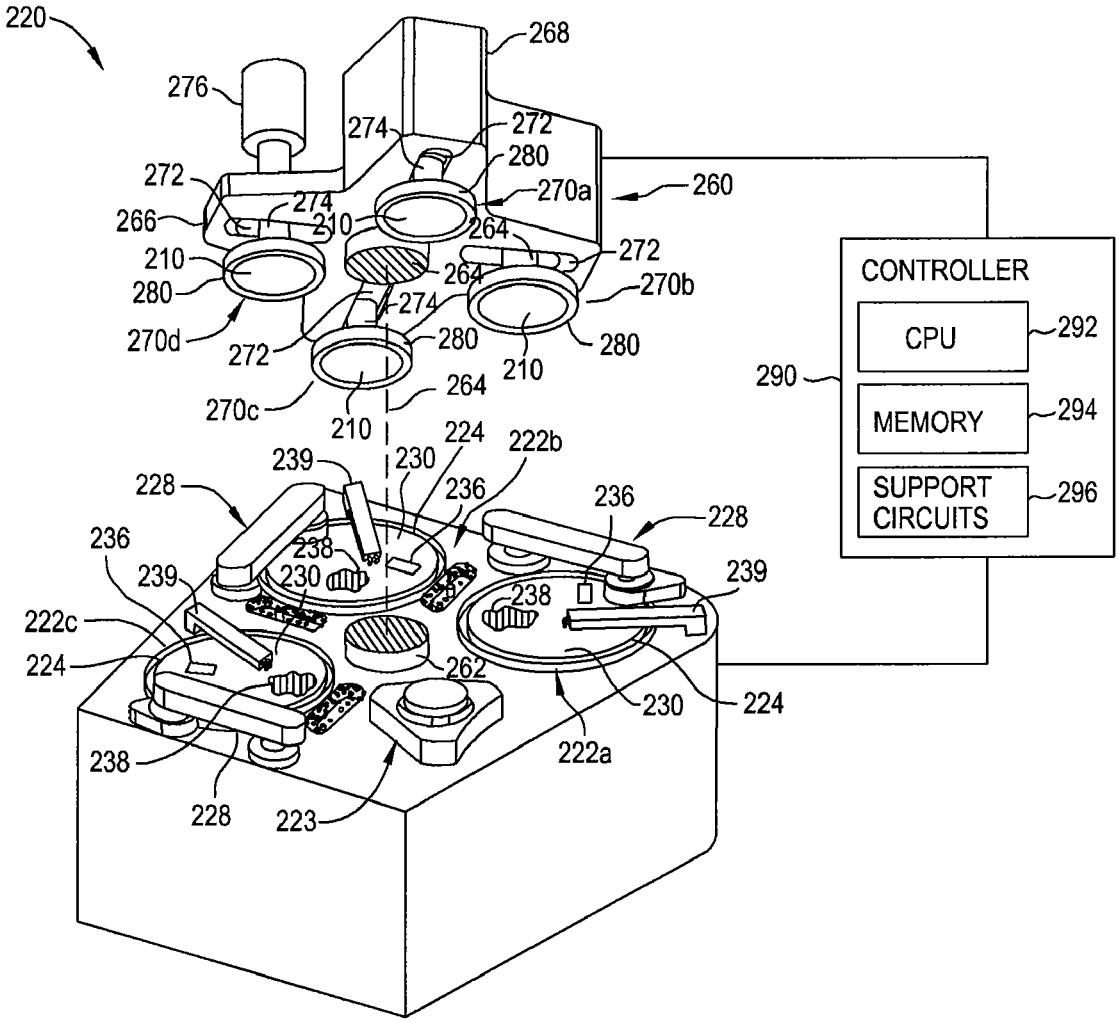
FIG. 2 is a schematic cross-sectional view of a chemical mechanical polishing apparatus.

FIG. 2 shows a chemical mechanical polishing apparatus 220 that can polish one or more substrates 210 such as wafers. Polishing apparatus 220 includes a series of polishing stations 222 and a transfer station 223. Transfer station 223 transfers the substrates between carrier heads 270 and a loading apparatus (not shown).

Each polishing station 222 includes a rotatable platen assembly 224 on which is placed a polishing pad assembly 230. The first and second stations 222 can include a two-layer polishing pad with a hard durable outer surface or a fixed-abrasive pad with embedded abrasive particles. The final polishing station 222 can include a relatively soft pad. Each polishing station 222 can also include a pad conditioner apparatus 228 to maintain the condition of the polishing pad 230 so that it will effectively polish substrates 210.

A rotatable multi-head carousel 260 supports four carrier heads 270. The carousel 260 is rotated by a central post 262 about a carousel axis 264 by a carousel motor assembly (not shown) to orbit the carrier head systems 270 and the substrates 210 attached thereto between polishing stations 222 and transfer station 223. Three of the carrier head systems 270 receive and hold substrates 210, and polish them by pressing them against the polishing pads 230. Meanwhile, one of the carrier head systems 270 receives a substrate 210 from and delivers a substrate 210 to the transfer station 223.

Each carrier head 270 is connected by a carrier drive shaft 274 to a carrier head rotation motor 276 (shown by the removal of one quarter of cover 268 so that each carrier head can independently rotate about it own axis). In addition, each carrier head 270 independently laterally oscillates in a radial slot 272 formed in carousel support plate 266. A description of a suitable carrier head 270 can be found in U.S. Pat. No. 6,422,927, entitled CARRIER HEAD WITH CONTROLLABLE PRESSURE AND LOADING AREA FOR CHEMICAL MECHANICAL POLISHING, the entire disclosure of which is incorporated by reference.

A slurry 238 containing an oxidizer (e.g., peroxide oxidizers or persulfate oxidizers) and an abrasive (e.g., silica) can be supplied to the surface of the polishing pad assembly 230 by a slurry supply port or combined slurry/rinse arm 239. If the polishing pad assembly 230 is a standard pad, slurry 238 can also include abrasive particles (e.g., silicon dioxide for oxide polishing). A clear window 236 is included in the polishing pad assembly 230 and is positioned such that it passes beneath substrate 210 during a portion of the platen's rotation, regardless of the translational position of the carrier head. The clear window 236 may be used for metrology devices, for example, an eddy current sensor may be placed below the clear window 236. In certain the window 236 and related sensing methods may be used for an endpoint detection process.

To facilitate control of the polishing apparatus 220 and processes performed thereon, a controller 290 comprising a central processing unit (CPU) 292, memory 294, and support circuits 296, is connected to the polishing apparatus 220. The CPU 292 may be one of any form of computer processor that can be used in an industrial setting for controlling various drives and pressures. The memory 294 is connected to the CPU 292. The memory 294, or computer-readable medium, may be one or more of readily available memory such as random access memory (RAM), read only memory (ROM), floppy disk, hard disk, or any other form of digital storage, local or remote. The support circuits 296 are connected to the CPU 292 for supporting the processor in a conventional manner. These circuits include cache, power supplies, clock circuits, input/output circuitry, subsystems, and the like.

Figure 3:
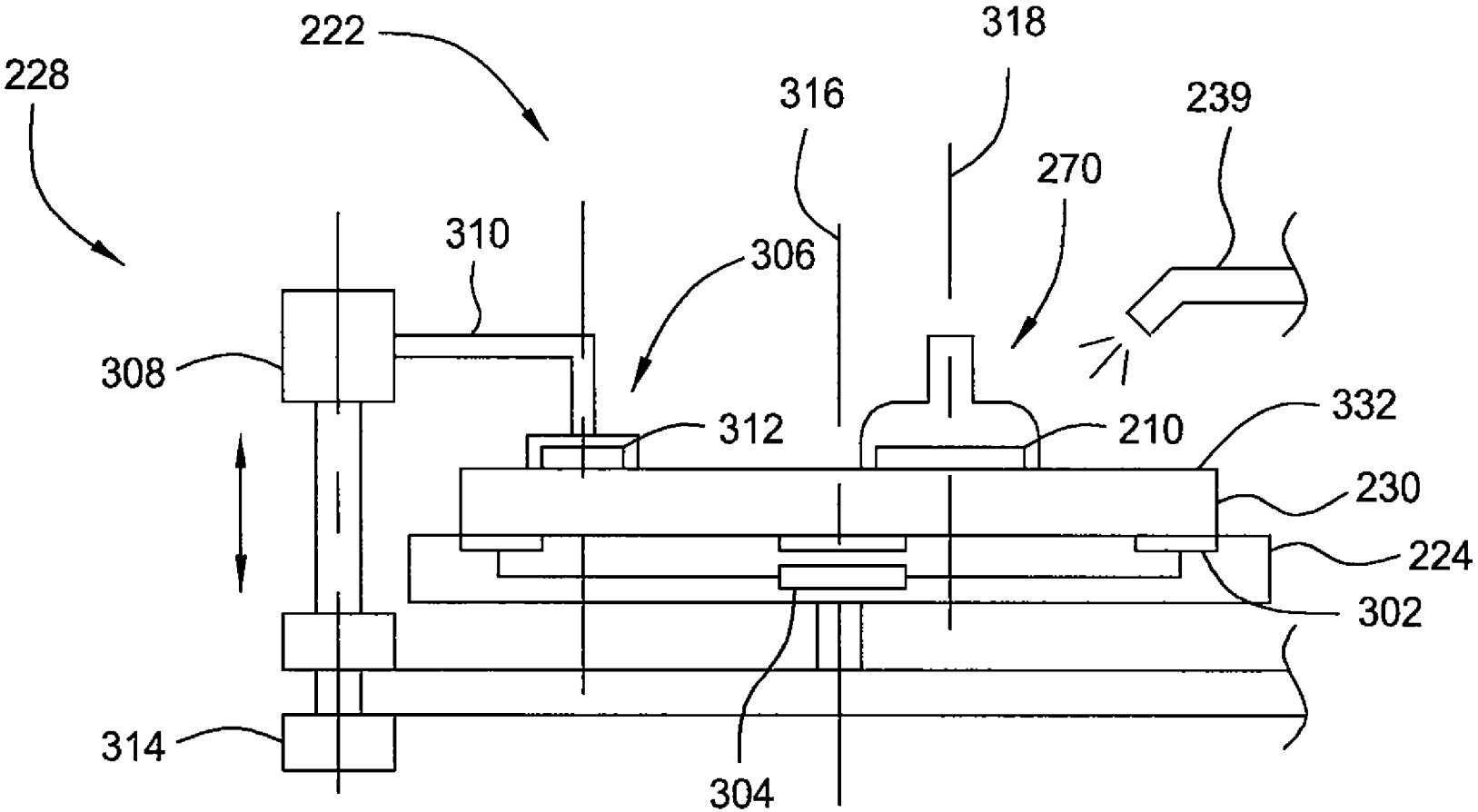
FIG. 3 is a schematic cross-sectional view of a polishing station.

FIG. 3 is a schematic cross-sectional view of a chemical mechanical polishing station 222 operable to polish a substrate 210. The polishing station 222 includes a rotatable platen assembly 224, on which a polishing pad assembly 230 is situated. The platen assembly 224 is operable to rotate about an axis as shown by arrow of FIG. 4. For example, a motor can turn a drive shaft (both not shown) to rotate the platen assembly 224. The polishing pad assembly 230 can be detachably secured to the platen assembly 224, for example, by a layer of adhesive. When worn, the polishing pad assembly 230 can be detached and replaced.

One or more temperature sensors 302 are disposed in respective cavities formed in an upper portion of the platen assembly 224. In one embodiment, the temperature sensor may comprise an infrared camera. The temperature sensors 302 are in electrical communication via wiring, with a thermostat 304. The thermostat 304 may be located in the platen assembly 224 or may be part of the controller 290. The thermostat 304 is in electrical communication with one or more power sources, via wiring.

In operation, the thermostat 304 is set to maintain the polishing pad assembly 230 at a predetermined temperature range. The thermostat 304 selectively operates the pad conditioner apparatus 228 to contact the polishing pad assembly 230 and correspondingly heat the polishing pad assembly 230 and polishing slurry 238 through friction until the polishing pad assembly 230 and/or slurry 238 reach the predetermined temperature range. The temperature sensors 302 provide feedback to the thermostat 304 to facilitate the thermostat 304 in reaching and maintaining the predetermined temperature range.

Figure 4:
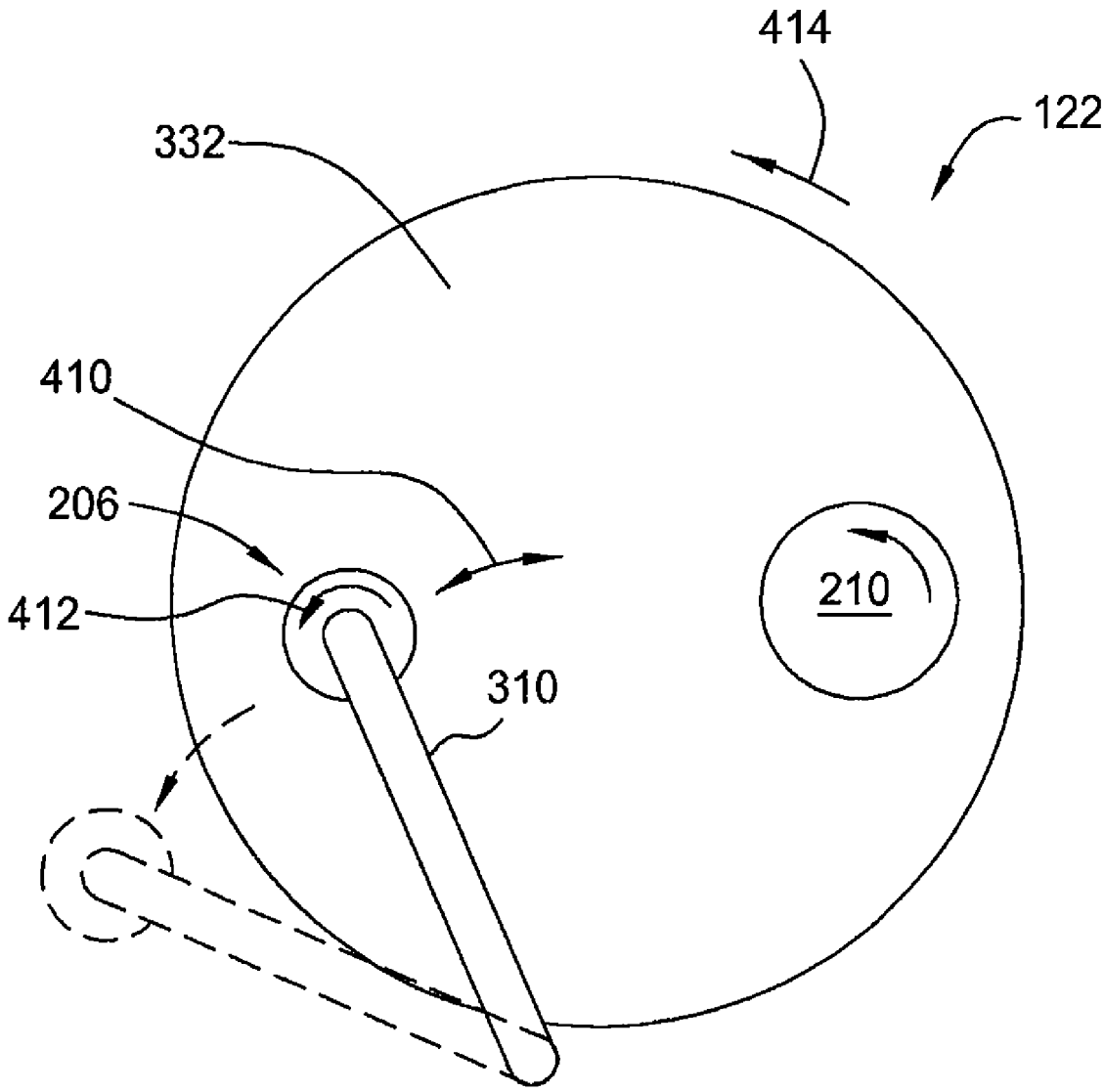
FIG. 4 is a schematic top view of another embodiment of a polishing station.

The pad conditioner apparatus 228 comprises a conditioning head 306 supported by a support assembly 308 with a support arm 310 therebetween. The support assembly 308 is coupled to a base 314 and is adapted to position the conditioning head 306 in contact with the pad assembly 230, and further is adapted to provide a relative motion (as shown in FIG. 4) therebetween. The conditioning head 306 is also configured to provide a controllable pressure acting as a down force to press the conditioning head 306 toward the polishing pad assembly 230. The down force pressure can be in a range between about 0.1 psi to about 30 psi, for example, between about 0.7 psi to about 2 psi. The conditioning head 306 generally rotates and/or moves laterally in a sweeping motion across the surface of the polishing pad assembly as indicated by arrows 410 and 412 (FIG. 4). In one embodiment, the lateral motion of the conditioning head 306 may be linear or along an arc in a range of about the center of the polishing pad assembly 230 to about the outer edge of the pad assembly 230, such that, in combination with the rotation of the pad assembly 230, the entire surface of the pad assembly 230 may be conditioned. The conditioning head 306 may have a further range of motion to move the conditioning head 306 beyond the edge of the pad assembly 230 when not in use.

The conditioning head 306 is adapted to house a conditioning element 312 to contact the pad assembly 230. The conditioning element 312 generally extends beyond the housing of the conditioning head 306 by about 0.2 mm to about 1 mm in order to contact the upper surface of the pad assembly 230. The conditioning element 312 can be made of nylon, cotton cloth, and polymers, such as: polyetheretherketone (PEEK), polyphenylene sulfide (PPS), Polyimide (Vespel™), PolyArylate (Ardel™), combinations thereof, and the like or other material that creates friction with the upper surface 332 of the pad assembly 230 without damaging the upper surface of the pad assembly 230. Alternatively, the conditioning element 312 may be made of a textured polymer or stainless steel having a roughened surface such as with diamond particles adhered thereto or formed therein. The diamond particles may range in size between about 30 microns to about 100 microns. Suitable conditioning elements are 3M™ Diamond Pad Conditioners and conditioning discs from the Kinik Co. of Taipei, Taiwan.

Returning to FIG. 2, the polishing station 222 includes a combined slurry/rinse arm 239. During polishing, the arm 239 is operable to dispense slurry 238 containing a liquid and a pH adjuster. Alternatively, the polishing station includes a slurry port operable to dispense slurry onto polishing pad assembly 230.

With reference to FIGS. 2 and 3, the polishing station 222 includes a carrier head 270 operable to hold the substrate 210 against the polishing pad assembly 230. The carrier head 270 is suspended from a support structure, for example, the carousel 260, and is connected by a carrier drive shaft 274 to a carrier head rotation motor 276 so that the carrier head can rotate about an axis 318. In addition, the carrier head 270 can oscillate laterally in a radial slot 272 formed in the support structure. In operation, the platen assembly 224 is rotated about its central axis 316, and the carrier head 270 is rotated about its central axis 318 and translated laterally across an upper surface 332 (see FIG. 3) of the polishing pad assembly 230.

Figure 5:
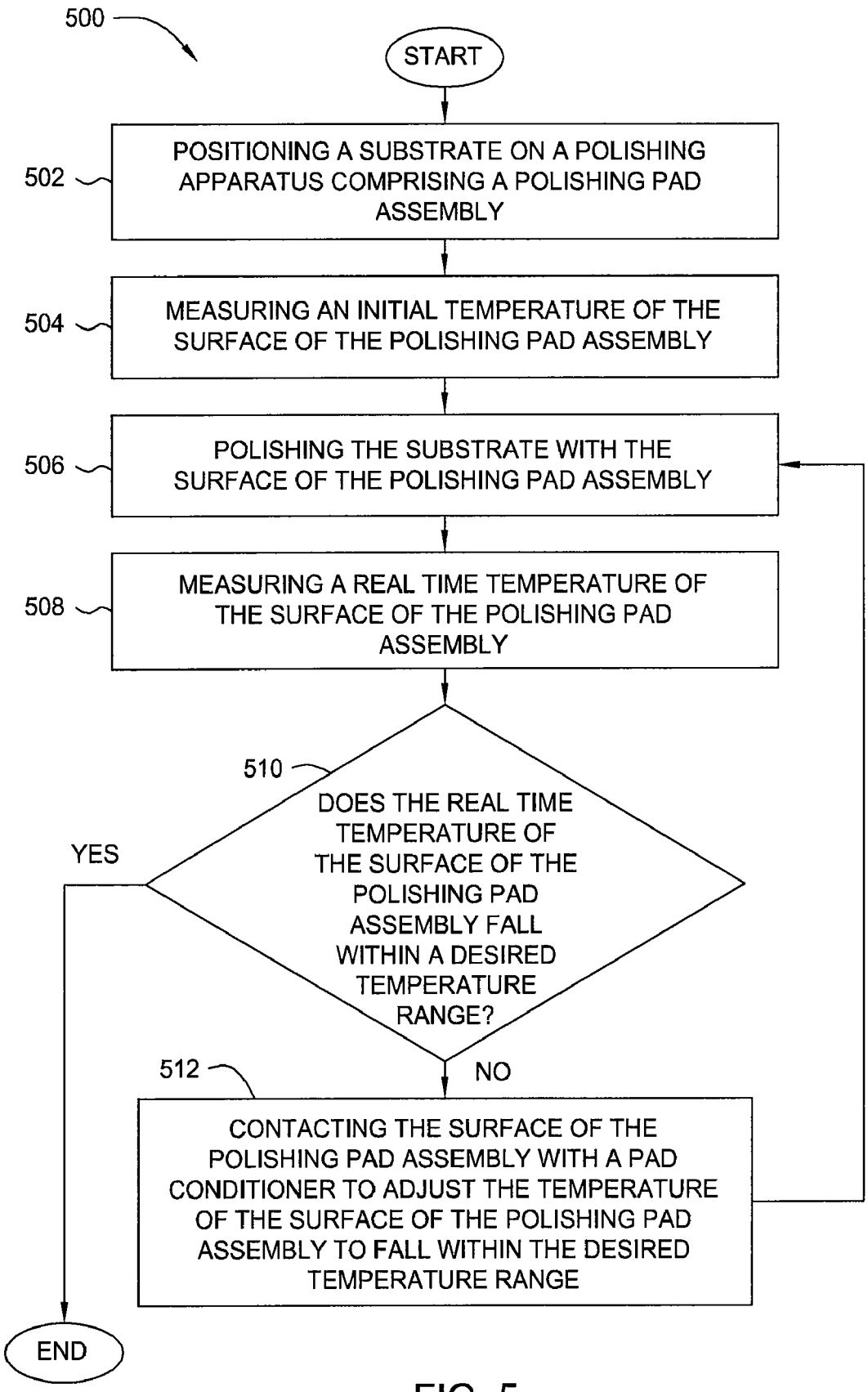
FIG. 5 is a flow chart of one embodiment of a polishing method described herein.

FIG. 5 is a flow chart of one embodiment of a polishing method 500 described herein. In one embodiment, the polishing method 500 enables selective control of the temperature of the surface of a polishing pad to tailor the removal profile of material from a substrate surface during a chemical mechanical polishing process. Advantageously, surface dishing is reduced and polishing uniformity is increased.

In one embodiment a method of processing a semiconductor substrate is provided. A substrate 210 is positioned on a polishing apparatus 220 comprising a polishing pad assembly 230 (step 502). The substrate 210 may have a material disposed thereon. Exemplary materials may include insulating materials, conductive materials, and combinations thereof. In one embodiment, the conductive material may be copper containing materials, tungsten containing materials, or any conductive material used in the industry to produce electronic devices. In one embodiment, an incoming or pre-polish profile determination is made, for example by measuring the thickness of materials over portions of the substrate. The profile determination may include determining the thickness profile of a conductive material across the surface of the substrate. A metric indicative of thickness may be provided by any device or devices designed to measure film thickness of semiconductor substrates. Exemplary non-contact devices include iSCAN™ and iMAP™ available from Applied Materials, Inc. of Santa Clara, Calif., which scan and map the substrate, respectively. The pre-polish profile determination may be stored in the controller 290.

An initial temperature of the upper surface 332 of the polishing pad assembly 230 may be measured (step 504). The initial temperature of the surface 332 of the polishing pad assembly 230 may be obtained using the temperature sensors 302 in the polishing pad assembly 230. In one embodiment, the temperature of the slurry may be obtained. The initial temperature readings may be stored in the thermostat 304 and/or controller 290.

The substrate 210 is polished with the surface 332 of the polishing pad assembly 230 (step 506). In this step, the substrate is brought into contact with the polishing pad assembly 230, more particularly, the conductive material on the substrate is brought into contact with the upper surface 332 of the polishing pad assembly 230. The polishing pad assembly 230 is rotated relative to the substrate 210, which is also rotated. In one embodiment, the polishing process may comprise a multi-step polishing process. For example, bulk conductive material may be removed on a first platen using a high removal rate process with any residual conductive material removed on a second platen using a "soft landing" or low pressure/low removal rate process. In one embodiment, the polishing process may be performed on a single platen.

During the polishing process, a polishing slurry is supplied to the polishing pad assembly 230. In certain embodiments, the polishing slurry may comprise an oxidizer, a passivation agent such as a corrosion inhibitor, a pH buffer, a metal complexing agent, abrasives, and combinations thereof. In one embodiment, the oxidizer is a persulfate oxidizer. In one embodiment, the persulfate oxidizer may be selected form the group consisting of ammonium persulfate, sodium persulfate, potassium persulfate, and combinations thereof. In another embodiment, the oxidizer is a peroxide oxidizer. In one embodiment, the peroxide oxidizer may be selected from the group consisting of a compound selected form the group consisting of hydrogen peroxide, sodium peroxide, perboric acid, percarbonate, urea peroxide, urea hydrogen peroxide, and combinations thereof. Suitable abrasives particles include inorganic abrasives, polymeric abrasives, and combinations thereof. Inorganic abrasive particles that may be used in the electrolyte include, but are not limited to, silica, alumina, zirconium oxide, titanium oxide, cerium oxide, germania, or any other abrasives of metal oxides, known or unknown. For example, colloidal silica may be positively activated, such as with an alumina modification or a silica/alumina composite.

During the polishing process, a real-time profile control (RTPC) model of the substrate may be developed. The thickness of a conductive material may be measured at different regions on the substrate. For example, the thickness of a metal layer at different regions on a substrate may be monitored to ensure that processing is proceeding uniformly across the substrate. Thickness information for regions of the substrate (which collectively may be referred to as a "profile" of the substrate) may then be used to adjust processing parameters in real time to obtain desired cross-substrate uniformity. For example, in a chemical mechanical polishing process, the thickness of a metal layer at different regions on the substrate may be monitored, and detected non-uniformities may cause the CMP system to adjust polishing parameters in real time. Such profile control may be referred to as real time profile control (RTPC). For example, in a CMP process, the thickness of the conductive material at different regions on the substrate may be monitored and detected non-uniformities may cause the CMP system to adjust polishing parameters in real time. RTPC may be used to control the remaining copper profile by adjusting zone pressures in the carrier polishing head.

During the polishing process, a conductive layer on the substrate may be processed. For example, a copper layer on a substrate may be polished with the CMP apparatus 220 including a multi-zone carrier head 270. While the substrate is being polished, profile data may be obtained for a region on the substrate. For example, eddy current data related to the thickness of a portion of the copper layer coupled with a magnetic field produced by an eddy current sensing system may be obtained during polishing. The profile data may be processed. For example, signal processing algorithms may be used to equate eddy current measurements with particular regions of the substrate. The processed profile data may then be compared to desired profile data to determine if a profile error is greater than a minimum acceptable error. If it is not, the processing parameters may be unchanged, and further profile data may be obtained for a different region on the substrate. For example, an eddy current sensor may be translated with respect to the substrate, so that profile information is obtained for regions at different radial distances from the center of the substrate. Note that the process of obtaining and processing data may occur as separate discrete steps for different regions of the substrate, may occur generally continuously and concurrently, with data acquisition occurring on timescales that are short compared to relative translation of an eddy current sensor with respect to a substrate. Moreover, after sorting the eddy current measurements into radial ranges, information on the metal film thickness can be fed in real-time into the controller 290 to periodically or continuously modify the polishing pressure profile applied by the carrier head 270. Examples of suitable RTPC techniques and apparatus are further described in U.S. Pat. No. 7,229,340, to Hanawa et al. entitled METHOD AND APPARATUS FOR MONITORING A METAL LAYER DURING CHEMICAL MECHANICAL POLISHING and U.S. patent application Ser. No. 10/633,276, entitled EDDY CURRENT SYSTEM FOR IN-SITU PROFILE MEASUREMENT, filed Jul. 31, 2003, now issued as U.S. Pat. No. 7,112,960, all of which are hereby incorporated by reference in their entirety.

A real-time temperature of the surface 332 of the polishing pad assembly 230 is measured (step 508). The real-time temperature of the surface 332 of the polishing pad assembly 230 may be continuously monitored during the polishing process using the temperature sensors 302 in the polishing pad assembly 230. The real-time temperature readings may be continuously transmitted to the thermostat 304 and/or the controller 290.

In one embodiment, the real-time temperature measurements of the substrate may be used to develop a real-time profile temperature model of the surface 332 of the polishing pad assembly 230. While the substrate is being polished, profile data may be obtained for a region on the surface 332 of the polishing pad assembly 230. For example, data related to the temperature of a portion of the surface 332 of the polishing pad assembly 230 may be obtained using the temperature sensors 302 during the polishing process. The profile data may be processed. For example, temperature processing algorithms may be used to equate temperature measurements with particular regions of the surface 332 of the polishing pad assembly 230. The processed temperature profile data may then be compared to desired profile temperature data to determine if a profile error is greater than a minimum acceptable error. If it is not, the conditioning parameters may be unchanged, and further profile data for another region of the surface 332 of the polishing pad assembly 230 may be obtained.

In one embodiment a line scan of temperature across the surface of the pad assembly may be performed so that temperature profile information is obtained for the plurality of regions at different radial distances from a center of the pad assembly 230. Note that the process of obtaining and processing data may occur as separate discrete steps for different regions of the substrate, may occur generally continuously and concurrently, with data acquisition occurring on timescales that are short compared to relative translation of the line scan temperature sensor with respect to the surface of the pad assembly 230. Moreover, after sorting the temperature measurements into radial ranges, information on the temperature profile of the surface 332 of the pad assembly 230 can be fed in real-time into the controller 290 to periodically or continuously to modify the conditioning pressure profile applied by the conditioning apparatus 228.

In one embodiment, the real-time temperature profile model of the polishing pad assembly 230 may be used in conjunction with the RTPC model of the substrate to adjust both the conditioning parameters for the pad conditioning apparatus and the polishing parameters in real-time to compensate for the thickness of the conductive material at different regions on the substrate. In one embodiment, an incoming thickness profile of a conductive material across the surface of a substrate is determined. The substrate is polished with a surface of the polishing pad assembly. During the polishing process, a real-time thickness profile model of the conductive material across the surface of the substrate is developed. During a polishing process a real-time temperature profile model of the surface of the polishing pad assembly is developed. The surface of the polishing pad assembly is contacted with a pad conditioner to adjust the temperature of the surface of the polishing pad assembly in response to the real-time thickness profile model of the conductive material across the surface of the substrate and the temperature profile model of the surface of the polishing pad assembly.

The real-time temperature of the surface 332 of the polishing pad assembly 230 is compared with a temperature range (step 510) predetermined to be optimal for a particular process. The predetermined temperature range may be determined by polishing a set-up substrate or series of set-up substrates with similar profiles using similar polishing conditions. Data from the set-up substrates may be stored in the controller 290. If the real-time temperature of the surface 332 of the polishing pad assembly 230 does not fall within the predetermined temperature range, the surface 332 of the polishing pad assembly 230 is contacted with the conditioning head 306 of the pad conditioning apparatus 228 to adjust the temperature of the surface 332 of the polishing pad assembly 230 to fall within the determined temperature range (step 512). Friction created between the pad conditioning apparatus 228 and the surface of the polishing pad assembly 230 increases the temperature of the surface of the polishing pad assembly 230. In one embodiment, the temperature of the surface of the polishing pad is increased from between about 20° C. to about 100° C., for example, between about 30° C. to about 70° C.

Adjusting the temperature of the surface of the pad may further comprise adjusting the conditioning parameters of the pad conditioning apparatus 228. Conditioning parameters include one or more of the conditioning head sweep range, denoted as arrow 410 (FIG. 4) above, a pressure or down force applied to a conditioning element during conditioning, a rotational speed or RPM applied to a conditioning element, and a conditioning head sweep frequency. One or more of the conditioning parameters may be adjusted alone, or in combination with at least one other conditioning parameter.

In one embodiment, the temperature of the surface of the pad assembly 230 may be adjusted in-situ while polishing the substrate. In one embodiment the conditioning head 306, the carrier head 270, and the upper surface 332 of the polishing pad assembly 230 and platen assembly 224, are rotated counterclockwise. Other embodiments are contemplated where the rotational direction of the pad, the carrier head 270, and the conditioning head 306 may be different.

Conditioning head down force may be adjusted to provide enhanced temperature control to various portions of the processing surface 332 of the polishing pad assembly 230. In one embodiment, the down force applied to the conditioning element relative the pad is static in a range between about 0.1 psi and about 30 psi, such as , between about 0.7 psi to about 2.0 psi, for example between about 1.0 psi to about 1.7 psi. In other embodiments, the conditioning parameters may be adjusted as described above, and the down force may be varied. For example, the down force may be increased when the conditioning head is conditioning the perimeter portion of the processing surface of the pad, and decreased when conditioning the processing surface of the center portion. In this embodiment, the perimeter of the polishing pad assembly 230 may be conditioned more aggressively to provide a higher surface temperature at the perimeter than the center portion. If a higher temperature at the center portion is desirable, than the down force could be higher when conditioning the center relative to the perimeter.

Conditioning element RPM may also be adjusted to provide enhanced temperature control to various portions of the processing surface of a polishing pad. In one embodiment, the conditioning element RPM may be set at some static RPM during conditioning. In one embodiment, the conditioning element RPM is between about 30 RPM to about 100 RPM, for example, between about 40 RPM to about 70 RPM. In other embodiments, the conditioning parameters may be adjusted as described above, and the conditioning element RPM may be varied. For example, the conditioning element RPM may be increased when the conditioning head is conditioning the perimeter portion of the pad, and decreased when conditioning the center portion. In this embodiment, the perimeter of the polishing pad assembly 230 may be conditioned more aggressively to provide a higher surface temperature at the perimeter than the center portion. If a higher temperature at the center portion is desirable, than the down force could be higher when conditioning the center relative to the perimeter.

In one embodiment, the surface of the polishing pad assembly may be selectively heated using the real-time temperature profile model of the pad surface as a guide. For example, if the real-time temperature profile model indicates that the temperature of the pad surface is higher on the edge of the pad than in the center of the pad, this may cause the polishing potential to diminish in portions of the processing surface of the pad that are in contact with the edge of the substrate. This local diminutive loss in removal rate may inhibit planarization of the conductive material on the substrate and detrimentally affect removal of conductive material from the substrate. Thus, preferentially heating the cooler portions of the processing surface restores the local loss in removal rate and/or increases the removal rate. For example, if the edge of the substrate is in contact with a perimeter portion of the processing surface of a circular pad relative to a center portion of the processing surface of the circular pad, the conditioning parameters may be adjusted to increase the temperature of the perimeter portion of the processing surface of the circular pad. In this instance, parameters such as conditioning element down force could be increased on the perimeter portion and/or sweep frequency could be optimized by stopping the conditioning head from its sweep for a time to allow the conditioning element to have a dwell time on the perimeter before returning to its sweep. In this example, the increased pressure and/or the dwell time on the perimeter of the circular pad will increase the temperature and corresponding performance of the processing surface of the pad, thereby positively affecting removal rate.

In other embodiments, sweep frequency of the conditioning head and conditioning element may be adjusted to selectively heat the surface of the polishing pad assembly. The sweep frequency may be adjusted to condition cooler portions of the processing surface of the pad more aggressively. For example, the sweep frequency could be based in part on the rotational speed of a circular pad. In this example, the geometry and RPM of the pad may necessitate a higher or lower sweep frequency based on real time temperature profile and the RTPC profile determination of the substrate.

In another embodiment, the range may be adjusted by varying the sweep range across the processing surface of a circular pad. For example, the center of a circular pad may be cooler relative to the perimeter of the circular pad, thus inhibiting planarization in the center portion. In this instance, the sweep range may be varied from a full radial sweep to a three quarter sweep wherein the sweep range conditions from about the center of the pad to about three-quarters of the radius from the center. In this example, the remaining quarter of the radius of the pad will not be conditioned. A three quarter sweep may be used inversely if the perimeter of the circular pad exhibits decreased planarization potential relative to the center portion, thus conditioning the perimeter and not conditioning a portion of the pad near the center of the pad. The sweep range adjustment is not limited to the fraction described and may be any fraction depending on conditioning needs of the pad.

In another embodiment, the temperature of the surface 332 of the polishing pad assembly 230 may be adjusted using a heating element disposed in or proximate to the platen assembly 224. The heating element may include an infrared lamp disposed in the platen assembly 224, an infrared lamp attached to the base, or an inductive coil disposed between the pad assembly 230 and the platen assembly 224. Using radiation localizes the heating to a desirable area on the surface 332 of the polishing pad assembly 230. In one embodiment, the radiation will only be turned on during the polishing process when the substrate is pressured on the pad, thus the substrate surface will not be illuminated and the light source wavelength can be selected without the concern of photo-corrosion of the conductive material.

If the real-time temperature of the surface 332 of the polishing pad assembly 230 falls within the determined temperature range, polishing of the substrate is completed and the process ends. In one embodiment, the real-time temperature profile and corresponding polishing parameters may be stored in the controller 290 and used to polish additional substrates with similar incoming profiles.

While the conditioning parameters disclosed herein have been exemplarily described in an in-situ process, the embodiments are not limited to this disclosure. In one embodiment, the conditioning parameters may be adjusted and the pad may be conditioned before or after a polishing process to heat the processing surface of the pad while foregoing the conditioning process during polishing. In other embodiments, the pad is heated in-situ, and before or after the polishing process to prepare the processing surface for a subsequent polishing process.

While the foregoing is directed to embodiments of the present invention, other and further embodiments of the invention may be devised without departing from the basic scope thereof, and the scope thereof is determined by the claims that follow.

The invention claimed is:

1. A method of processing a semiconductor substrate, comprising:

polishing the substrate with a surface of a polishing pad assembly;

measuring a real-time temperature of the surface of the polishing pad assembly;

contacting the surface of the polishing pad assembly with a pad conditioner to adjust the temperature of the surface of the polishing pad assembly; and controlling force applied to the polishing pad assembly by the pad conditioner based on the measured, real-time temperature, wherein the force affects friction to adjust the temperature of the surface of the polishing pad assembly as the pad conditioner moves across the surface of the polishing pad assembly.

2. The method of claim 1, wherein the contacting the surface of the polishing pad assembly increased the temperature of the surface of the pad assembly by creating friction on the surface of the polishing pad assembly.

3. The method of claim 1, wherein contacting the surface of the polishing pad assembly comprises adjusting at least one of a conditioning head sweep range, a conditioning head sweep frequency, a down force pressure applied by the conditioning element to the pad assembly, and a rotational speed applied to a conditioning element.

4. The method of claim 3, wherein the down force pressure is between about 0.7 psi and about 2.0 psi.

5. The method of claim 1, wherein a conductive material selected from the group of copper containing materials, tungsten containing materials, and combinations thereof is polished on the surface of the substrate.

6. The method of claim 1, wherein the pad conditioner comprises a conditioning element comprising a polymer material selected from the group comprising polyetheretherketone (PEEK), polyphenylene sulfide (PPS), Polyimide (Vespel™) PolyArylate (Ardel™), and combinations thereof.

7. The method of claim 1, wherein the polishing the substrate with a surface of a polishing pad assembly further comprises applying a polishing slurry to the substrate wherein the polishing slurry comprises a persulfate oxidizer.

8. The method of claim 7, wherein the polishing slurry is selected form the group consisting of ammonium persulfate, sodium persulfate, potassium persulfate, and combinations thereof.

9. A method of processing a semiconductor substrate, comprising:

polishing the substrate with a surface of a polishing pad assembly;

measuring a series of real-time temperature measurements from a plurality of regions on the surface of the polishing pad assembly;

equating each real-time temperature measurement with a particular region of the plurality of regions on the surface of the polishing pad assembly;

determining whether each real-time temperature measurement of the surface of the polishing pad assembly is within a predetermined processing temperature range; and contacting at least one of the plurality of regions of the surface of the polishing pad assembly with a pad conditioner to adjust the temperature of the surface of the polishing pad assembly to fall within the predetermined temperature range.

10. The method of claim 9, wherein the measuring a series of real-time temperature measurements comprises performing a line scan of temperature across the surface of the pad assembly so that temperature profile information is obtained for the plurality of regions at different radial distances from a center of the pad assembly.

11. The method of claim 10, further comprising:

sorting the temperature profile information into radial ranges; and feeding the temperature profile information on the temperature profile to a controller to periodically or continuously modify the polishing pressure profile applied by the conditioning apparatus to the surface of the polishing pad assembly.

12. The method of claim 9, wherein contacting the surface of the polishing pad assembly comprises adjusting at least one of a conditioning head sweep range, a conditioning head sweep frequency, a down force pressure applied by the conditioning element to the pad assembly, and a rotational speed applied to a conditioning element.

13. The method of claim 12, wherein the down force pressure is between about 0.7 psi and about 2.0 psi.

14. The method of claim 9 wherein the contacting the surface of the polishing pad assembly increased the temperature of the surface of the pad assembly by creating friction on the surface of the polishing pad assembly.

15. The method of claim 9 wherein a conductive material is selected from the group comprising copper containing materials, tungsten containing materials, and combinations thereof.

16. The method of claim 9 wherein the pad conditioner comprises a conditioning element comprising a polymer material selected from the group comprising polyetheretherketone (PEEK), polyphenylene sulfide (PPS), Polyimide (Vespel™), PolyArylate (Ardel™), and combinations thereof.

17. A method of processing a semiconductor substrate, comprising:

determining an incoming thickness profile of a conductive material across the surface of the substrate;

polishing the substrate with a surface of a polishing pad assembly;

developing a real-time thickness profile model of the conductive material across the surface of the substrate;

developing a real-time temperature profile model of the surface of the polishing pad assembly; and contacting the surface of the polishing pad assembly with a pad conditioner to adjust the temperature of the surface of the polishing pad assembly in response to the real-time thickness profile model of the conductive material across the surface of the substrate and the temperature profile model of the surface of the polishing pad assembly.

18. The method of claim 17, wherein the developing a real-time thickness profile model of the conductive material comprises monitoring the thickness of the conductive material at different regions on the surface of the substrate.

19. The method of claim 18, wherein the developing a real-time temperature profile model of the surface of the polishing pad assembly comprises:

measuring a series of real-time temperature measurements from a plurality of regions on the surface of the polishing pad assembly;

equating each real-time temperature measurement with a particular region of the plurality of regions on the surface of the polishing pad assembly; and determining whether each real-time temperature measurement of the surface of the polishing pad assembly is within a predetermined processing temperature range.

20. The method of claim 17, wherein contacting the surface of the polishing pad assembly comprises adjusting the conditioning head sweep range, a conditioning head sweep frequency, a pressure applied to a conditioning element, a rotational speed applied to a conditioning element, and combinations thereof.

* * * * *

UNITED STATES PATENT AND TRADEMARK OFFICE

CERTIFICATE OF CORRECTION

PATENT NO. : 8,292,691 B2
APPLICATION NO. : 12/240615
DATED : October 23, 2012
INVENTOR(S) : Xu et al.

It is certified that error appears in the above-identified patent and that said Letters Patent is hereby corrected as shown below:

In the Drawings:

Sheet 5 of 6, please delete "122" and insert -- 222 -- therefor;

Sheet 5 of 6, please delete "206" and insert -- 306 -- therefor.

Signed and Sealed this
Fifth Day of March, 2013

Teresa Stanek Rea
*Acting Director of the United States Patent and Trademark Office*